US005685692A

United States Patent [19]

Grzina

[11] Patent Number: 5,685,692

[45] Date of Patent: Nov. 11, 1997

[54] PUMP HOUSING ASSEMBLY

[75] Inventor: Anthony Grzina, Drummoyne, Australia

[73] Assignee: Warman International Limited, Artarmon, Australia

[21] Appl. No.: 591,262

[22] Filed: Dec. 4, 1995

Related U.S. Application Data

[63] Continuation of PCT/AU94/00277, May 25, 1994.

[30] Foreign Application Priority Data

Jun. 4, 1993 [AU] Australia ..... PL9206
Feb. 1, 1994 [AU] Australia ..... PM3642

[51] Int. Cl.[6] ..... F01D 25/24

[52] U.S. Cl. ..... 415/126; 415/128

[58] Field of Search ..... 415/196, 197, 415/127, 128, 126

[56] References Cited

U.S. PATENT DOCUMENTS

| | | | |
|---|---|---|---|
| 678,223 | 7/1901 | Christian | 415/128 |
| 1,952,179 | 3/1934 | Milkowski et al. | 415/196 |
| 3,656,861 | 4/1972 | Zagar | 415/197 |
| 5,197,863 | 3/1993 | Dardis et al. | 415/128 |

FOREIGN PATENT DOCUMENTS

| | | | |
|---|---|---|---|
| 1277835 | 1/1961 | France | 415/197 |
| 544674 | 4/1942 | United Kingdom | 415/197 |
| 897907 | 5/1962 | United Kingdom | 415/197 |

*Primary Examiner*—John T. Kwon
*Attorney, Agent, or Firm*—Darby & Darby

[57] ABSTRACT

A pump housing assembly having two parts, each part including an outer casing and an inner lining of elastomeric material. An insert component comprising a body, including a lining section, is sandwiched between the housing parts and cooperates with the inner lining of the two housing parts to form a pump chamber. The insert component further includes a drainage hole extending through the lining section of the component for permitting drainage of fluid from the pump chamber.

15 Claims, 5 Drawing Sheets

PUMP HOUSING ASSEMBLY

This is a continuation of international application Ser. No. PCT/AU94/00277, filed May 25, 1994.

BACKGROUND OF THE INVENTION

This invention relates generally to pumps and more particularly, to slurry pumps of the type which include an outer casing and an inner lining of elastomeric material such as for example rubber or the like.

FIGS. 1*a* and 1*b* of the accompanying drawings are a schematic partial top view and partial sectional view respectively of a conventional pump.

Referring to the FIGS. 1*a* and 1*b*, there is shown a pump generally indicated at 10 which comprises a pump housing assembly 12 having two parts 13 and 14 arranged to be assembled together. Each part of the housing assembly comprises an outer casing 16 and an inner lining 18 made of rubber or other elastomer.

When assembled the two parts form a pump chamber 20 having an inlet 21 and an outlet 22. The outlet section of the homing assembly is provided with a flange 23 with bolt mounting apertures 25 for receiving bolts of other fastening devices. The two parts of the housing assembly are secured together by means of fastening bolts 28.

Disposed within the pump chamber 20 is an impeller 24 mounted for rotation on an impeller shaft 26. The impeller 24 comprises a series of vanes 29 as shown.

It is important that slurry pumps of this type are capable of working under extreme climatic conditions such as in regions where it is very hot or where temperatures fall below freezing. In currently known pumps, often there is a residual of slurry which remains within the pump after it has ceased operation. This slurry residual is undesirable and can (under certain circumstances) lead to pump damage under certain climatic conditions.

Pumps of this type have an optimum running efficiency (referred to as the best efficiency) which occurs at a particular flow rate. It is desirable in many instances to increase the flow rate at which the optimum running efficiency is achieved. It is known that this can be achieved by increasing the width of the impeller. The width of an impeller however is limited by the width of the pump chamber within the housing assembly. The manufacture and design of pump housings can be complicated and expensive and as such it is not always practical to redesign a pump to improve the flow rate characteristics.

It is an object of the present invention to provide an improved pump housing assembly which alleviates one or more of the aforementioned problem.

According to one aspect of the invention there is provided a pump housing assembly, the assembly including a housing comprising two parts, each part including an outer casing and an inner lining of the elastomeric material, and an insert component comprising a body including a lining section, the component being adapted to be received between the two aforementioned housing parts when the housing assembly is assembled, the lining section being arranged so as to co-operate with the inner lining of the two housing parts so as to form a pump chamber therein when assembled, and a drainage hole extending through the lining section of the component for permitting the drainage of fluid from the pump chamber. In use the drainage .hole may be provided with a suitable stop means for closing the drainage hole.

According to another aspect of the present invention there is provided an insert component suitable for use with a pump housing assembly, the assembly including a housing comprising two parts, each part including an outer casing and an inner lining of the elastomeric material, the insert component comprising a body including a lining section, the component being adapted to be received between the two aforementioned housing parts when the housing assembly is assembled, the lining section being arranged so as to co-operate with the inner lining of the two housing parts so as to form a pump chamber therein when assembled, and a drainage hole extending through the lining section of the component for permitting the drainage of fluid from the pump chamber.

The insert component may further include an outer case section which is arranged for co-operation with the outer casing of the two housing parts.

Preferably, the walls of the body of the insert component may substantially conform to the shape of the walls of the two housing parts.

Preferably, the outer casing section is provided with mounting apertures arranged to co-operate with respective mounting apertures on the two housing parts for receiving fastening bolts or other fastenings for retaining the housing assembly in the assembled position.

BRIEF DESCRIPTION OF THE DRAWINGS

A preferred embodiment of the invention will hereinafter be described with reference to the accompanying drawings, in which.

BRIEF DESCRIPTION OF THE PREFERRED EMBODIMENTS

Figure 1A:
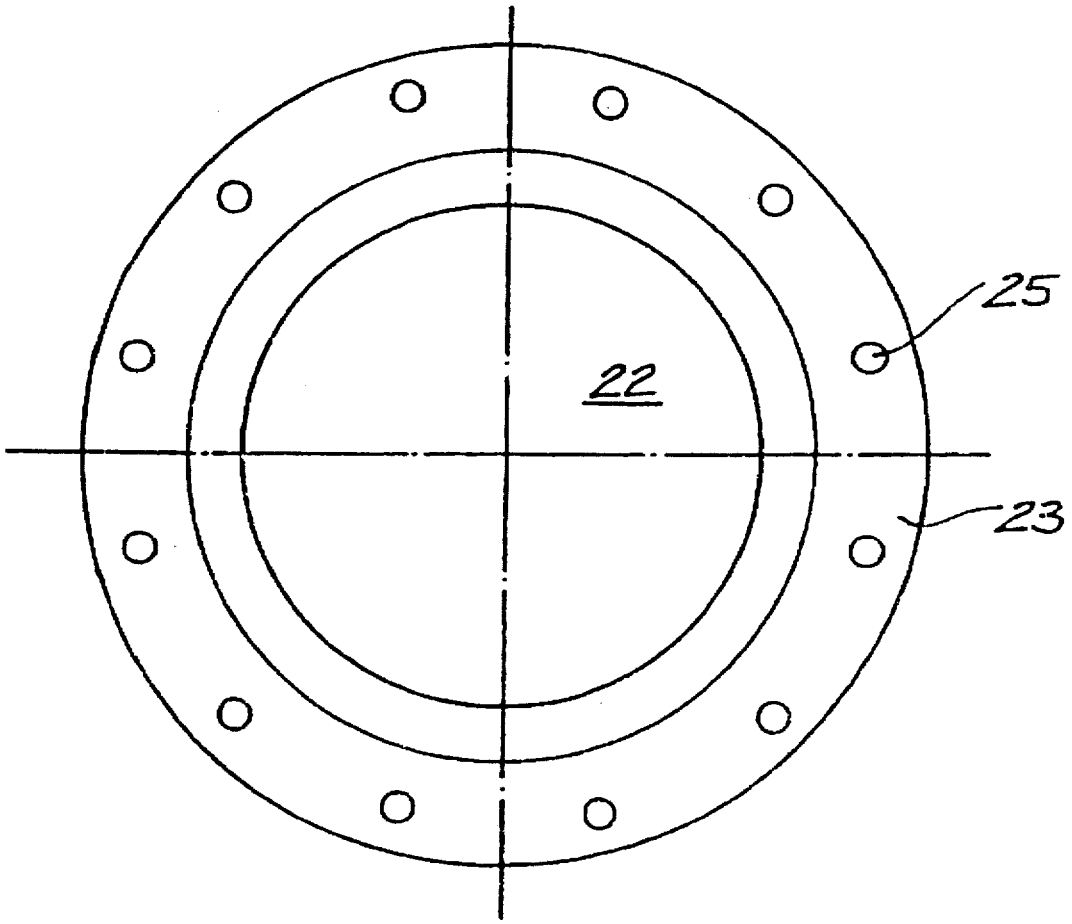
FIG. 1a (PRIOR ART)
FIG. 1*a* and 1*b* are a schematic partial top view and partial sectional view of a conventional pump.
Figure 1B:
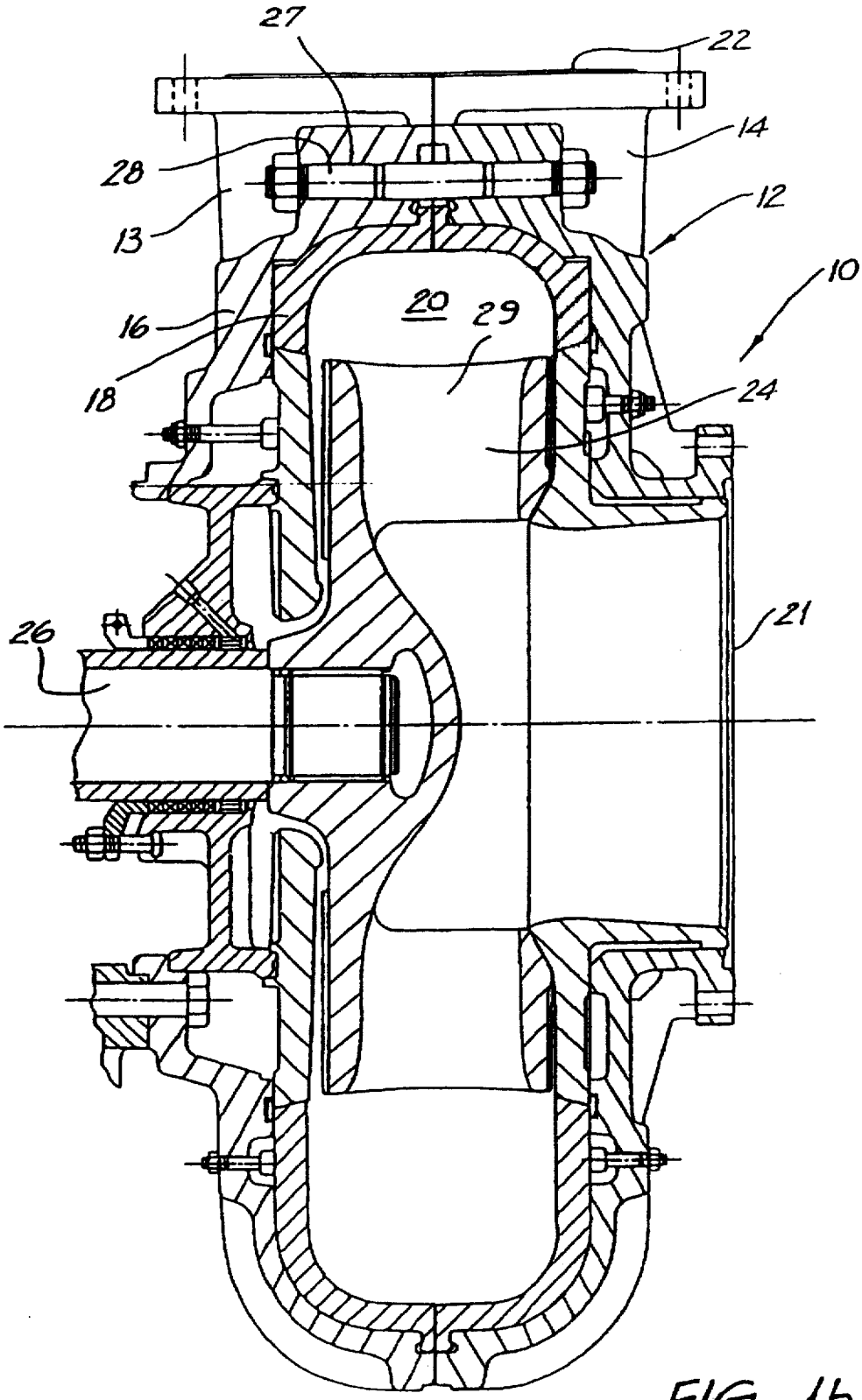
FIG. 1b (PRIOR ART)
Figure 2A:
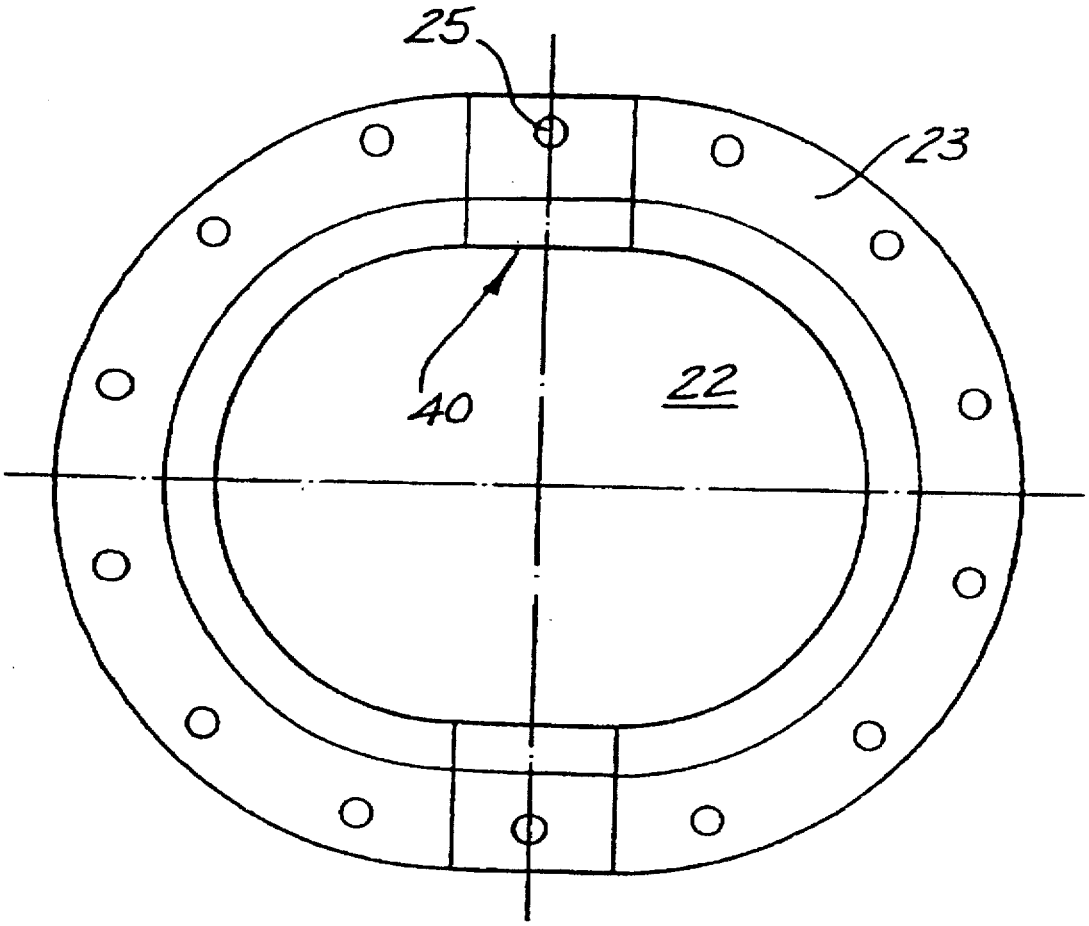
FIG. 2*a* and 2*b* are a schematic partial top view and partial sectional view of a pump homing assembly according to the present invention.
Figure 2B:
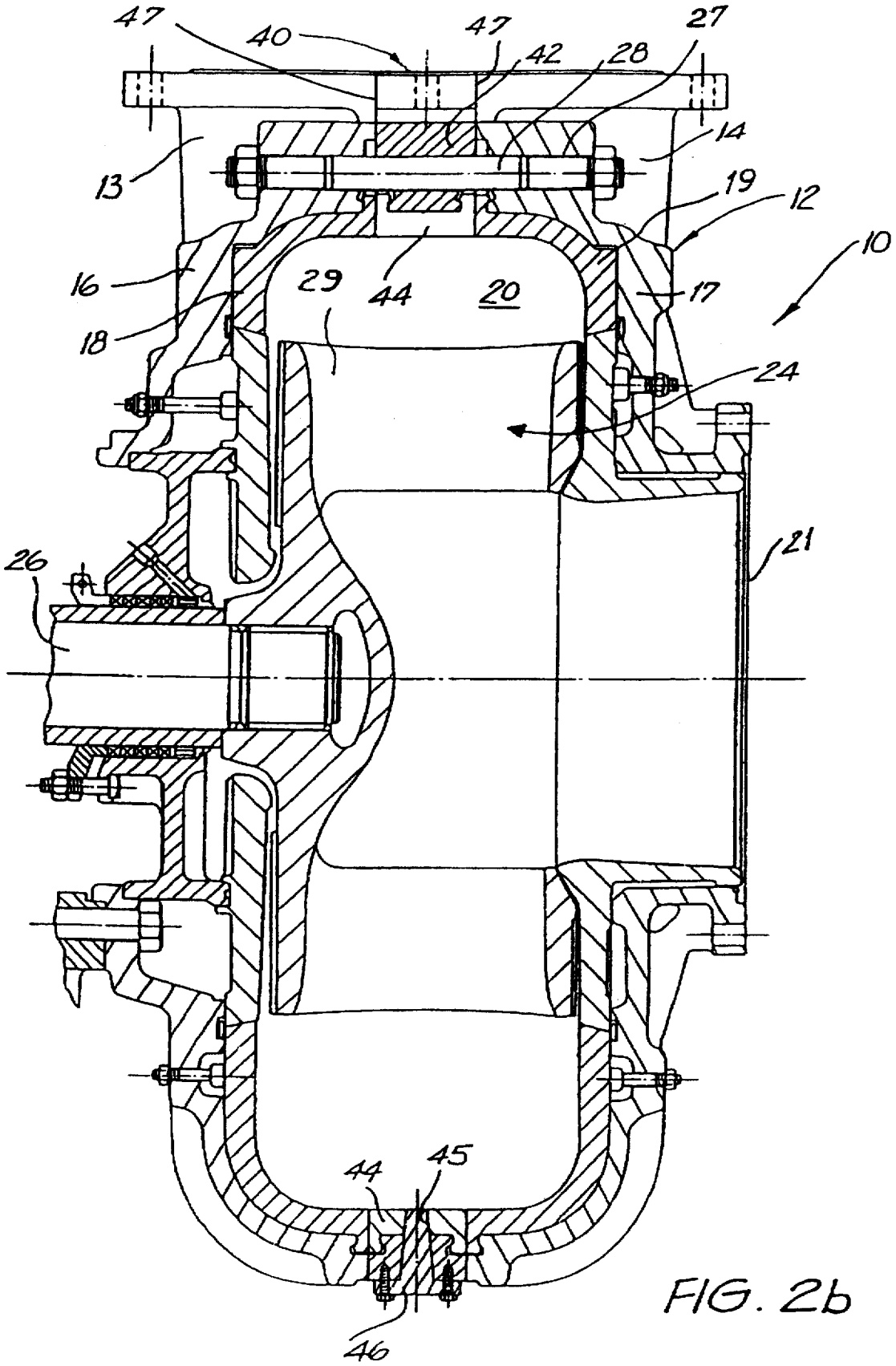

The pump 10 shown in FIGS. 2*a* and 2*b* includes a homing assembly 12 having two parts 13 and 14 each of which includes a metal outer casing 16 and 17 and elastomeric inner liner 18 and 19. In addition, and in accordance with the present invention, the homing assembly further includes an insert component 40 which in the assembled position is sandwiched between parts 13 and 14. The two parts 13 and 14 and insert component 40 have edge sections which include abutment faces 47 thereon which have substantially the same contour so that when the three parts are brought together in the assembled position the respective abutment faces form a seal so that the interior of the housing assembly forms a pump chamber 20. The pump chamber has an inlet 21 and an outlet 22 with an impeller 24 mounted for rotation within the chamber on shaft 26 in conventional fashion.

The insert component 40 includes an outer metal wall section 42 and an inner elastomeric liner section 44 arranged to co-operate with respective portions on the two parts 13 and 14. The inner liner section 44 extends in continuous fashion from one side of the insert component to the other. As a result of this a drain hole 45 can be formed in the wall of the insert extending from the external surface through metal wall section 42 and liner section 44 into the pump chamber. The drain hole may be closed by stopper 46 or any other suitable manner.

Fastening bolts 28 pass through mounting apertures 27 in parts 13 and 14 and the insert component 40 to hold the unit in the assembled position. The impeller 24 is mounted on an impeller shaft 26 and disposed within the pump chamber 20.

It will be appreciated that by providing an insert component 40 the width of the impeller used in association with housing assembly parts 13 and 14 can be substantially increased thereby improving the flow rate of the pump at an optimum efficiency.

The advantages of the pump according to the present invention are more clearly explained by making reference to the FIGS. 3 to 6. The only practical position for a drain hole is between the two parts 13 and 14 of the homing assembly 12. Considering the conventional pump housing shown in FIGS. 3 and 4 this would require that the drain holes 45 be formed partially in each of the two liner sections 18; that is half of the drain hole would be formed in one section of the lining and the other half formed in the other section. Thus, the complete drain hole is formed when the two parts are brought together.

Figure 3:
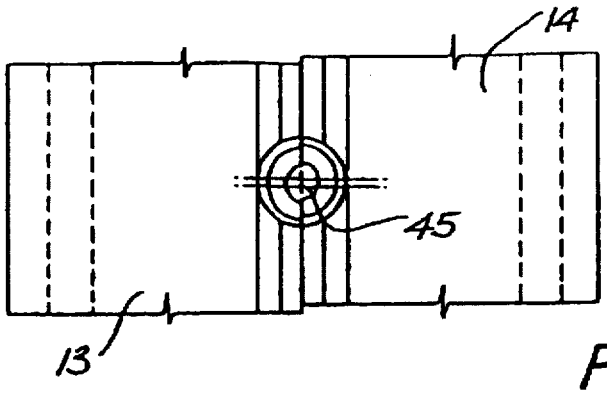
FIG. 3 (PRIOR ART)
FIGS. 3 and 4 are schematic views of a conventional pump housing assembly with a drain hole illustrating the potential problems with such an assembly.
Figure 4:
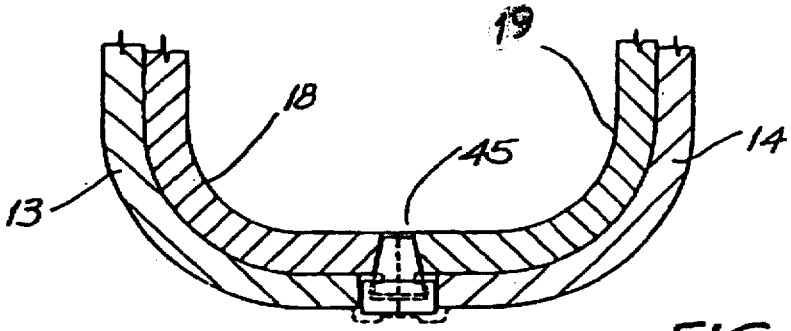
FIG. 4 (PRIOR ART)

It will be appreciated that matching of the two halves of the drain hole during assembly of the pump would be difficult. This problem would be amplified because the liner parts are compressed during assembly thereby distorting the liners making it even more difficult to match the sections of the drain hole. Furthermore, it is often the case that one half of the lining is not a precise mirror image of the other half and this can cause more difficulties. The distortion is illustrated in FIG. 3.

Figure 5:
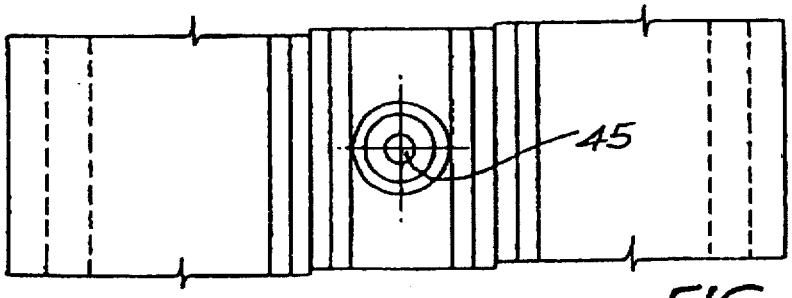
FIGS. 5 and 6 are schematic views of a pump homing assembly according to the present invention.
Figure 6:
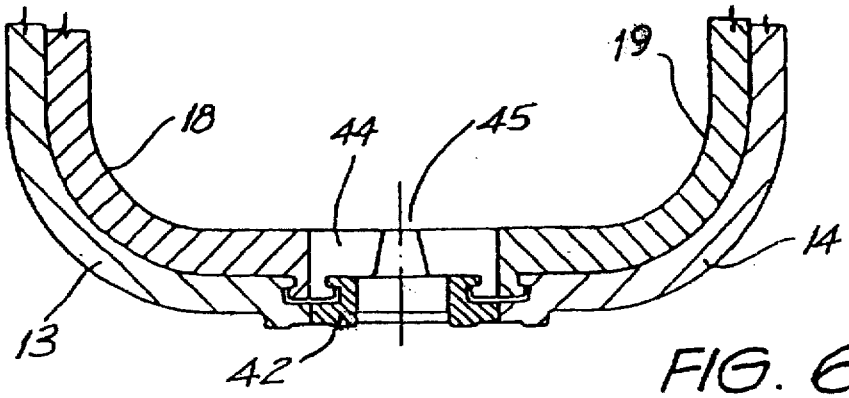

With the arrangement of the present invention as shown in FIGS. 5 and 6 these problems do not exist because the drain hole is formed as a single unit within the insert component 44.

It will be further appreciated that by providing an insert component 40 the width of the impeller used in association with housing assembly parts 13 and 14 can be substantially increased thereby improving the flow rate of the pump at an optimum efficiency.

Finally, it is to be understood that various alterations, modifications and/or additions may be incorporated into the various constructions and arrangements of parts without departing from the spirit or ambit of the invention.

I claim:

1. A pump housing assembly, the assembly including a housing comprising two parts, each part including an outer casing and an inner lining of elastomeric material, and an insert component comprising a body including a lining section, the insert component being positioned between said two housing parts when the housing assembly is assembled, said lining section being sandwiched between the inner lining of the two housing parts so as to form a pump chamber therein when assembled, said insert component further including a drainage hole extending through said lining section of the insert component for permitting the drainage of fluid from the pump chamber.

2. A pump housing assembly according to claim 1 further including stop means for closing the drainage hole.

3. A pump housing assembly according to claim 2, wherein said insert component further includes an outer casing section, said casing section and said outer casing of the two housing parts forming an outer casing for said pump housing.

4. A pump housing assembly according to claim 3 wherein said walls of the body of the insert component substantially conform to the shape of the walls of the two housing parts.

5. A pump housing according claim 4, wherein the outer casing section is provided with mounting apertures aligned with respective mounting apertures on the two housing parts for receiving fastening bolts for retaining the housing assembly in the assembled position.

6. A pump housing assembly according claim 2 wherein said walls of the body of the insert component substantially conform to the shape of the walls of the two housing parts.

7. A pump housing according to claim 2, wherein the outer casing section is provided with mounting apertures aligned with respective mounting apertures on the two housing parts for receiving fastening bolts for retaining the housing assembly in the assembled position.

8. A pump housing according to claim 3, wherein the outer casing section is provided with mounting apertures aligned with respective mounting apertures on the two housing parts for receiving fastening bolts for retaining the housing assembly in the assembled position.

9. A pump housing assembly according to claim 1, wherein said insert component further includes an outer casing section, said casing section and said outer casing of the two housing parts forming an outer casing for said pump housing.

10. A pump housing assembly according claim 1 wherein said walls of the body of the insert component substantially conform to the shape of the walls of the two housing parts.

11. A pump housing according to claim 1, wherein the outer casing section is provided with mounting apertures aligned with respective mounting apertures on the two housing parts for receiving fastening bolts for retaining the housing assembly in the assembled position.

12. An insert component suitable for use with a pump housing assembly, the assembly including a housing comprising two parts, each part including an outer casing and an inner lining of the elastomeric material, the insert component comprising a body including a lining section, the component being positioned between the two aforementioned housing parts when the housing assembly is assembled, the lining section being sandwiched between the inner lining of the two housing parts so as to form a pump chamber therein when assembled, and a drainage hole extending through the lining section of the component for permitting the drainage of fluid from the pump chamber.

13. An insert component according to claim 12 further comprising stop means for closing the drainage hole.

14. An insert component according to claim 13 further including an outer case section.

15. An insert component according to claim 12 further including an outer case section.

* * * * *